US006334430B1

(12) United States Patent
Itabashi

(10) Patent No.: US 6,334,430 B1
(45) Date of Patent: Jan. 1, 2002

(54) INTAKE AIR AMOUNT CONTROL SYSTEM FOR ENGINE

(75) Inventor: Shinji Itabashi, Miyagi (JP)

(73) Assignee: Keihin Corporation, Tokyo (JP)

( * ) Notice: Subject to any disclaimer, the term of this patent is extended or adjusted under 35 U.S.C. 154(b) by 0 days.

(21) Appl. No.: 09/691,074

(22) Filed: Oct. 19, 2000

(30) Foreign Application Priority Data

Oct. 19, 1999 (JP) ..... 11-297177

(51) Int. Cl.[7] ..... F02M 3/12
(52) U.S. Cl. ..... 123/336; 123/580
(58) Field of Search ..... 123/336, 579, 123/580, 339.13

(56) References Cited

U.S. PATENT DOCUMENTS 3,252,539 A * 5/1966 Ott et al. ..... 123/336
4,161,928 A * 7/1979 Teague et al. ..... 123/336
5,367,998 A * 11/1994 Shiohara et al. ..... 123/580
6,105,562 A * 8/2000 Akagi et al. ..... 123/580
6,202,626 B1 * 3/2001 Ito et al. ..... 123/336

FOREIGN PATENT DOCUMENTS

JP 10-176637 6/1998

* cited by examiner

*Primary Examiner*—Erick Solis
(74) *Attorney, Agent, or Firm*—Arent Fox Kintner Plotkin & Kahn, PLLC

(57) ABSTRACT

An intake air amount control system for an engine includes a plurality of throttle devices each of which is comprised of a butterfly-type throttle valve rotatably carried in an intake passage body and which are disposed in a pair at two points spaced from each other in a direction perpendicular to rotational axes of the throttle valves. The intake passage bodies of the throttle devices disposed at the two points are connected to each other by at least one connecting member. In such intake air amount control system, bypass air passages are provided on opposed sides of the intake passage bodies forming a pair to extend around the throttle valves, respectively, and air control valves mounted on the opposed sides of the intake passage bodies for controlling the opening degrees of the bypass air passages, respectively. A synchronizing mechanism is disposed between the pair of throttle devices for synchronizing the operations of the air control valves. Thus, the idling rotational speed of the engine can be stabilized, while avoiding an increase in size of the intake air amount control system.

6 Claims, 8 Drawing Sheets

INTAKE AIR AMOUNT CONTROL SYSTEM FOR ENGINE

BACKGROUND OF THE INVENTION

1. Field of the Invention

The present invention relates to an intake air amount control system for an engine, including a plurality of throttle devices each of which comprises a butterfly-type throttle valve rotatably carried in an intake passage body defining an intake passage for controlling the opening degree of the intake passage, the throttle devices being disposed in a pair at each of two points spaced from each other in a direction perpendicular to rotational axes of the throttle valves, the intake passage bodies of the throttle devices disposed at the two points being connected to each other by at least one connecting member.

2. Description of the Related Art

Such intake air amount control system is conventionally known, for example, from Japanese Patent Application Laid-open No. 10-176637 and the like, and designed such that the throttle valves of the pair of throttle devices are driven in operative association with each other by an interlocking mechanism.

In the above intake air amount control system, the pair of throttle valves are operated in association with each other so that they are opened slightly upon starting of the engine. Thus, the opening degree of each of the throttle valves is small and for this reason, there is a possibility that the amount of air at the start of the engine may be unstable, whereby the idling rotational speed of the engine becomes unstable.

SUMMARY OF THE INVENTION

Accordingly, it is an object of the present invention to provide an intake air amount control system including a plurality of throttle devices, wherein the idling rotational speed of an engine can be stabilized, while avoiding an increase in size of the intake air amount control system.

To achieve the above object, according to a first aspect and feature of the present invention, there is provided an intake air amount control system for an engine, comprising a plurality of throttle devices each of which comprises a butterfly-type throttle valve rotatably carried in an intake passage body defining an intake passage for controlling the opening degree of the intake passage, the throttle devices being disposed in a pair at each of two points spaced from each other in a direction perpendicular to rotational axes of the throttle valves, the intake passage bodies of the throttle devices disposed at the two points being connected to each other by at least one connecting member, the intake air amount control system further including bypass air passages mounted on opposed sides of the intake passage bodies forming a pair so as to extend around the throttle valves, respectively, air control valves mounted on the opposed sides of the intake passage bodies for controlling the opening degrees of the bypass air passages, respectively, and a synchronizing mechanism disposed between the pair of the throttle devices for synchronizing the operations of the air control valves.

With such arrangement, the bypass air passage is provided in the intake passage body of each of the throttle devices to extend around the throttle valve, and the amount of air flowing through the bypass air passage can be controlled by the air control valve. Therefore, the control of the small amount of air at the start of the engine can be carried out stably, whereby the idling rotational speed can be stabilized, as compared with the prior art in which the amount of air at the start of the engine is controlled by decreasing the opening degree of the throttle valve. In addition, the bypass air passages provided in the intake passage bodies and the air control valves mounted to the intake passage bodies are disposed on opposed sides of the intake passage bodies forming the pair. Therefore, it is possible to avoid an increase in size of the entire intake air amount control system, in spite of the provision of the bypass air passages and the air control valves. Moreover, since the synchronizing mechanism for synchronously operating the air control valves is disposed between the throttle devices forming the pair, the size of the entire intake air amount control system cannot be increased due to the provision of the synchronizing mechanism.

According to a second aspect and feature of the present invention, in addition to the first feature, the intake passage bodies forming the pair and having an identical shape, and the air control valves mounted to the intake passage bodies and having an identical shape are disposed symmetrically with respect to a center lying between both the intake passages and established on a straight line passing through axes of the intake passages in the intake passage bodies. With such arrangement, the preparation of a plurality of types of throttle devices is not needed, thereby enabling a reduction in cost and a simplification of the construction of the synchronizing mechanism.

According to a third aspect and feature of the present invention, in addition to the second feature, the connecting member is formed into a flat plate-shape. With such arrangement, the shape of the connecting member can be simplified, thereby providing a reduction in cost.

According to a fourth aspect and feature of the present invention, in addition to any of the first to third features, the synchronizing mechanism is supported on the connecting member. With such arrangement, an exclusive part for supporting the synchronizing mechanism is not required, whereby the number of parts can be reduced.

According to a fifth aspect and feature of the present invention, in addition to the second or third feature, the throttle passage bodies of the pair of throttle devices are disposed at a distance from each other in a direction parallel to the rotational axes of the throttle valves included in the throttle devices, and are connected to each other by a pair of the connecting members which form a substantially right-angled tetragon by cooperation with the intake passage bodies, and the synchronizing mechanism includes a first lever supported on an inner surface of one of the connecting members and connected to the air control valve of one of the throttle devices, a second lever supported on an inner surface of the other connecting member and connected to the air control valve of the other throttle device, and a synchronizing member disposed on a diagonal line of the substantially right-angled tetragon and connecting the first and second levers to each other. With such arrangement, sufficient strengths of the pair of throttle devices can be ensured and moreover, it is possible to protect the synchronizing mechanism by the connecting members and to simplify the synchronizing mechanism.

According to a sixth aspect and feature of the present invention, in addition to the first feature, a choke wire assembly is supported on the connecting member and connected to the synchronizing mechanism. With such arrangement, the structure of interconnection of the synchronizing mechanism and the choke wire assembly can be simplified, while increasing the degree of freedom of disposition of the choke wire assembly.

The above and other objects, features and advantages of the invention will become apparent from the following description of the preferred embodiment taken in conjunction with the accompanying drawings.

BRIEF DESCRIPTION OF THE DRAWINGS

FIGS. 1 to 8 show an embodiment of the present invention, wherein

FIG. 1 is a plan view of the entire arrangement of an intake air amount control system;

FIG. 2 is a side view taken in the direction of an arrow 2 in FIG. 1;

FIG. 3 is a plan view similar to FIG. 1, except for a fuel supply system and throttle valves;

FIG. 4 is a side view of an intake passage body taken in a direction of an arrow 4 in FIG. 3;

FIG. 5 is an enlarged sectional view taken along a line 5—5 in FIG. 4;

FIG. 6 is an enlarged sectional view taken along a line 6—6 in FIG. 4;

FIG. 7 is an enlarged sectional view taken along a line 7—7 in FIG. 4; and FIG. 8 is an enlarged sectional view taken along a line 8—8 in FIG. 7.

DESCRIPTION OF THE PREFERRED EMBODIMENT

Figure 1:
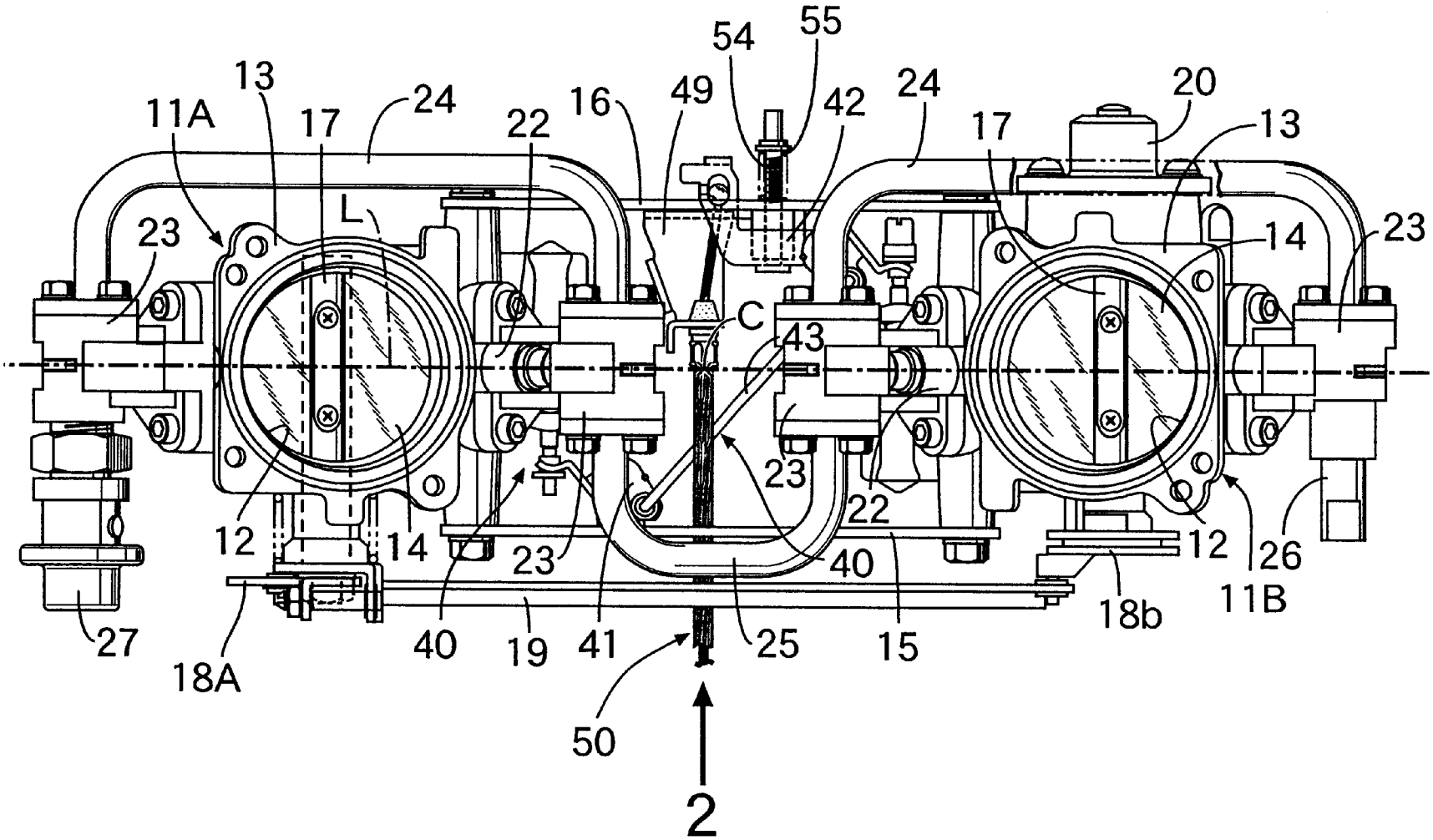
Figure 2:
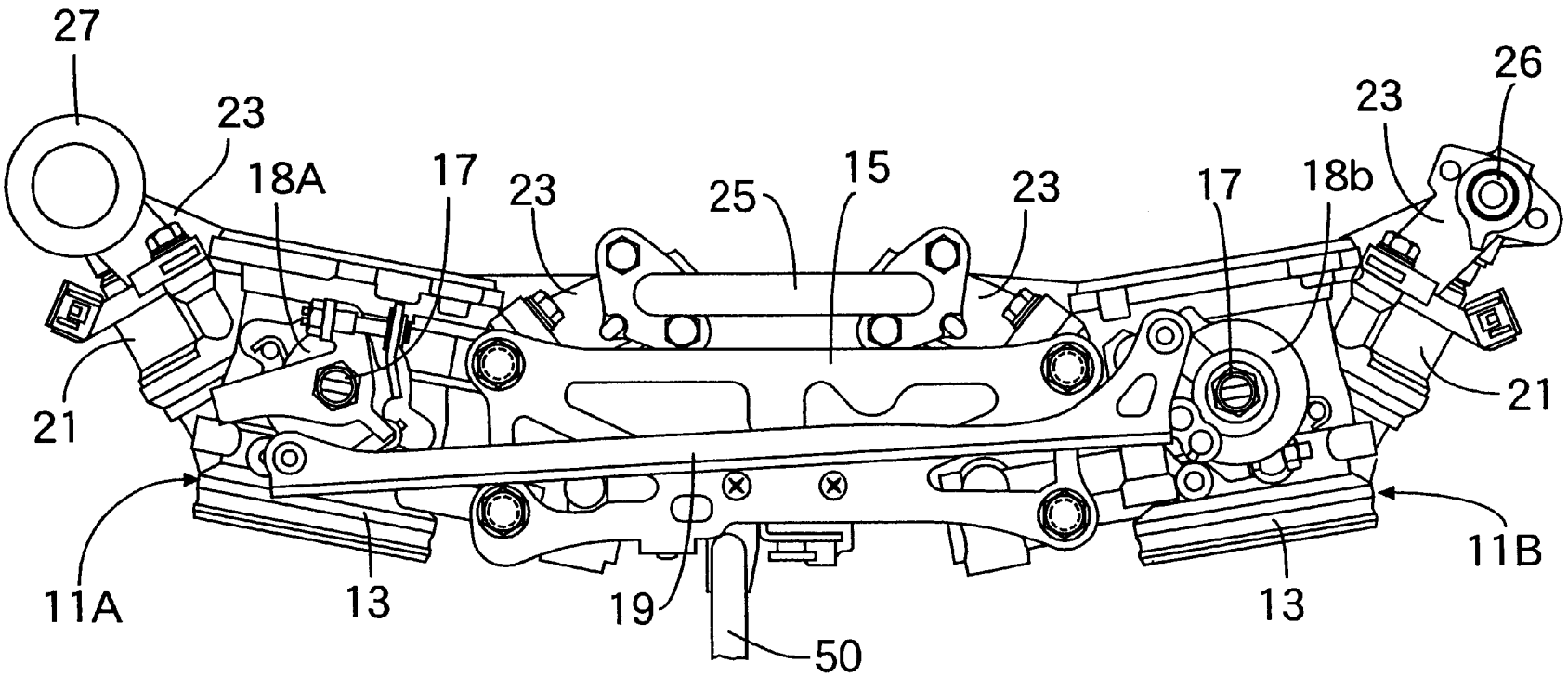

The present invention will now be described by way of an embodiment with reference to FIGS. 1 to 8. Referring first to FIGS. 1 and 2, an intake air amount control system is used in a V-shaped 2-cylinder engine, and includes first and second throttle devices 11A and 11B individually corresponding to cylinders of the engine.

Each of the first and second throttle devices 11A and 11B comprises a butterfly valve 14 which is rotatably carried in an intake passage body 13 defining an intake passage 12 connected to an intake port in each of the cylinders in the engine, and which is capable of controlling the opening degree of the intake passage 12. The first and second throttle devices 11A and 11B are disposed in a pair at two places spaced apart from each other in a direction perpendicular to rotational axes of the throttle valves 14.

The intake passage bodies 13 of the throttle devices 11A and 11B have an identical shape, and are disposed symmetrically with each other with respect to a center C lying between both the intake passages 12 and established on a straight line L passing through the axes of the intake passages 12 provided respectively in the intake passage bodies 13. The intake passage bodies 13 are disposed at a distance from each other in a direction parallel to the rotational axes of the throttle valves 14, and connected to each other by a pair of connecting members 15 and 16 forming a substantially right-angled tetragon together with both the intake passage bodies 13. Each of the connecting members 15 and 16 is formed into a flat plate-shape parallel to the straight line L.

The throttle valves 14 are secured to valve stems 17 rotatably supported in the intake passage bodies 13, respectively. A throttle drum 18A is secured at one end of the valve stem 17 protruding from the intake passage body 13 of the first throttle device 11A, and a throttle drum 18B is secured at one end of the valve stem 17 protruding from the intake passage body 13 of the second throttle device 11B. Moreover, the throttle drums 18A and 18B are connected to each other by a connecting member 19, so that the drums 18A and 18B, that is, the valve stems 17 are rotated in operative association with each other by rotating the second throttle drum 18B by a throttle wire (not shown), whereby the opening degrees of the throttle valves 14 are controlled in operative association with each other. An opening degree sensor 20 for detecting an opening degree of the throttle valve 14 is mounted to the intake passage body 13 of the second throttle device 11B and connected to the other end of the valve stem 17 on the side opposite to the second throttle drum 18B.

Pairs of fuel injection valves 21 and 22 for injecting fuel into the intake passages 12 at locations downstream of throttle valves 14 included in the throttle devices 11A and 11B are mounted on opposite sides of the intake passage bodies 13 in the throttle devices 11A and 11B, respectively such that their axes are disposed in a plane perpendicular to axes of the valve stems 17.

The fuel injection valves 21 and 22 are clamped between the intake passage bodies 13 and valve support members 23 mounted to the intake passage bodies 13.

The valve support member 23 is fastened to the intake passage body 13 and has a fuel passage leading to a rear end of each of the fuel injection valves 21 and 22. Substantially U-shaped pipes 24 leading to the fuel passages are connected at their opposite ends to the pair of valve support members 23 for each of the throttle devices 11A and 11B, and substantially U-shaped pipes 25 leading to the fuel passages are connected at their opposite ends to the valve support members 23 for mounting the fuel injection valves 22 to the first and second throttle devices 11A and 11B. A fuel inlet joint 26 for connecting the injection valve 21 to a fuel supply pump (not shown) is mounted to the valve support member 23 for mounting the fuel injection valve 21 to the second throttle device 11B, and a regulator 27 for returning a surplus amount of fuel to a fuel tank (not shown) is connected to the valve support member 23 for mounting the fuel injection valve 21 to the first throttle device 11A.

Referring to FIGS. 3 to 7, a bypass passage 30 is provided in each of opposed sides of the intake passage bodies 13 to extend around the throttle valve 14, and comprises an upstream passage portion 30*a* which opens at its upstream end into the intake passage 12 at a location upstream of the throttle valve 14, and a downstream passage portion 30*b* which opens at its downstream end into the intake passage 12 at a location downstream of the throttle valve 14. An air control valve 31 is mounted on each of the opposite sides of the intake passage bodies and disposed between the upstream passage portion 30*a* and the downstream passage portion 30*b* of the bypass air passage 30 to control the opening degree of the bypass air passage 30. Thus, the upstream passage portion 30*a* and the downstream passage portion 30*b* of the bypass air passage 30 are defined in the intake passage body 13 in such a manner that they are bent at a plurality of points.

Figure 8:
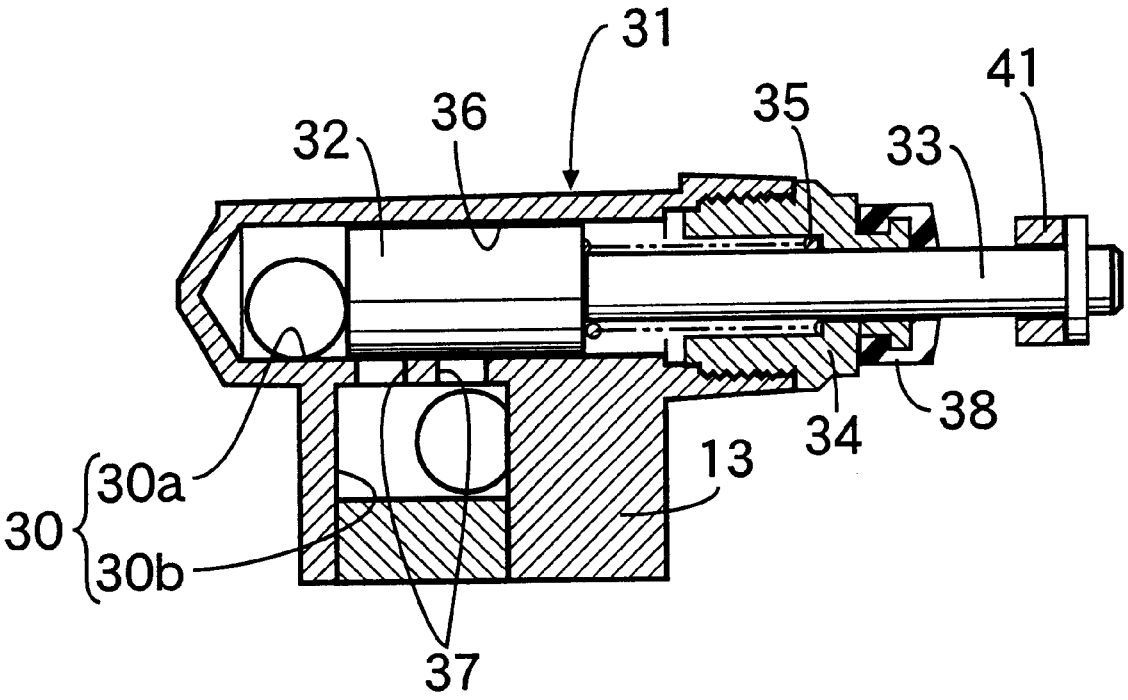

Referring further to FIG. 8, the air control valve 31 includes a columnar valve member 32 slidably fitted in the intake passage body 13, a rod 33 coaxially connected to the valve member 32 and protruding outwards from the intake passage body 13, a guide member 34 screwed into the intake passage body 13 for guiding the axial movement of the rod 33, and a return spring 35 mounted between the guide member 34 and the valve member 32.

A slide bore 36 having a substantially horizontal axis is provided in the intake passage body 13 and connected to a downstream end of the upstream passage portion 30*a* of the bypass air passage 30, and the valve member 32 is slidably received in the slide bore 36. A plurality of, for example, three valve bores 37 are provided in parallel and in a partially lapped manner in a direction along an axis of the slide bore 36. The valve bores 37 are connected to an upstream end of the downstream passage portion 30*b* of the bypass air passage 30 and open into an inner surface of the slide bore 36. With such arrangement of the valve bores 37, the opening area of a path between the upstream passage portion 30*a* and the downstream passage portion 30*b* of the bypass air passage 30 is varied proportionally by the sliding movement of the valve member 32 within the slide bore 36.

The return spring 35 is mounted between the guide member 34 and the valve member 32 to exhibit a spring force for biasing the valve member 32 in a direction to decrease the opening area of a path between the upstream passage portion 30*a* and the downstream passage portion 30*b* of the bypass air passage 30. Mounted at an outer end of the guide member 34 screwed into the intake passage body 13 to occlude an outer end of the slide bore 36 is a boot 38 for sealing the guide 34 and the rod 33 axially movably passed through the guide member 34 from each other.

Such bypass air passages 30 are provided in an identical shape in the opposed sides of the intake passage bodies 13, respectively, and the air control valves 31 having an identical shape are mounted to the intake passage bodies 13, respectively. Moreover, the air control valves 31 are disposed symmetrically with respect to the center C established on the straight line L.

Figure 3:
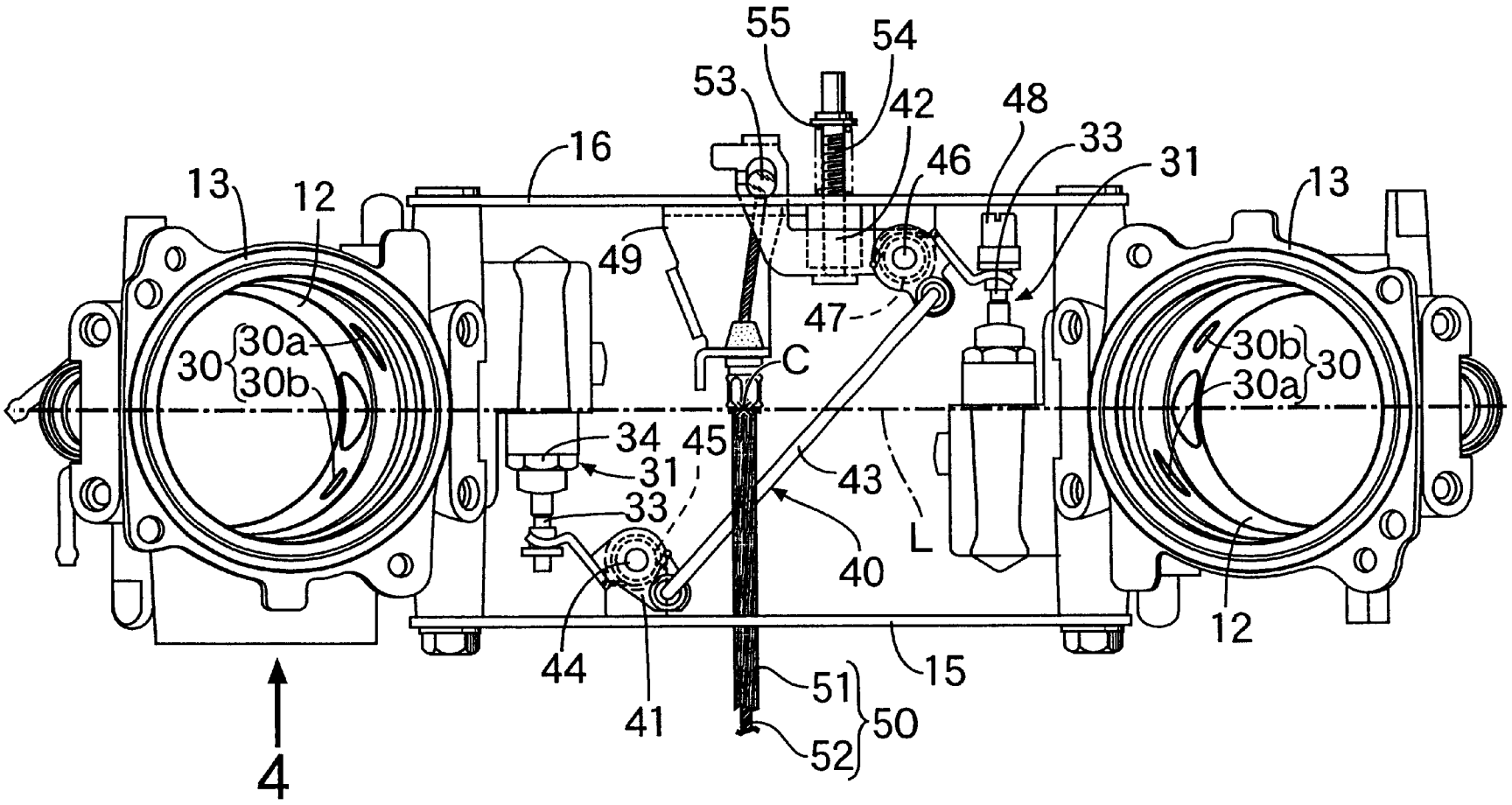
Figure 4:
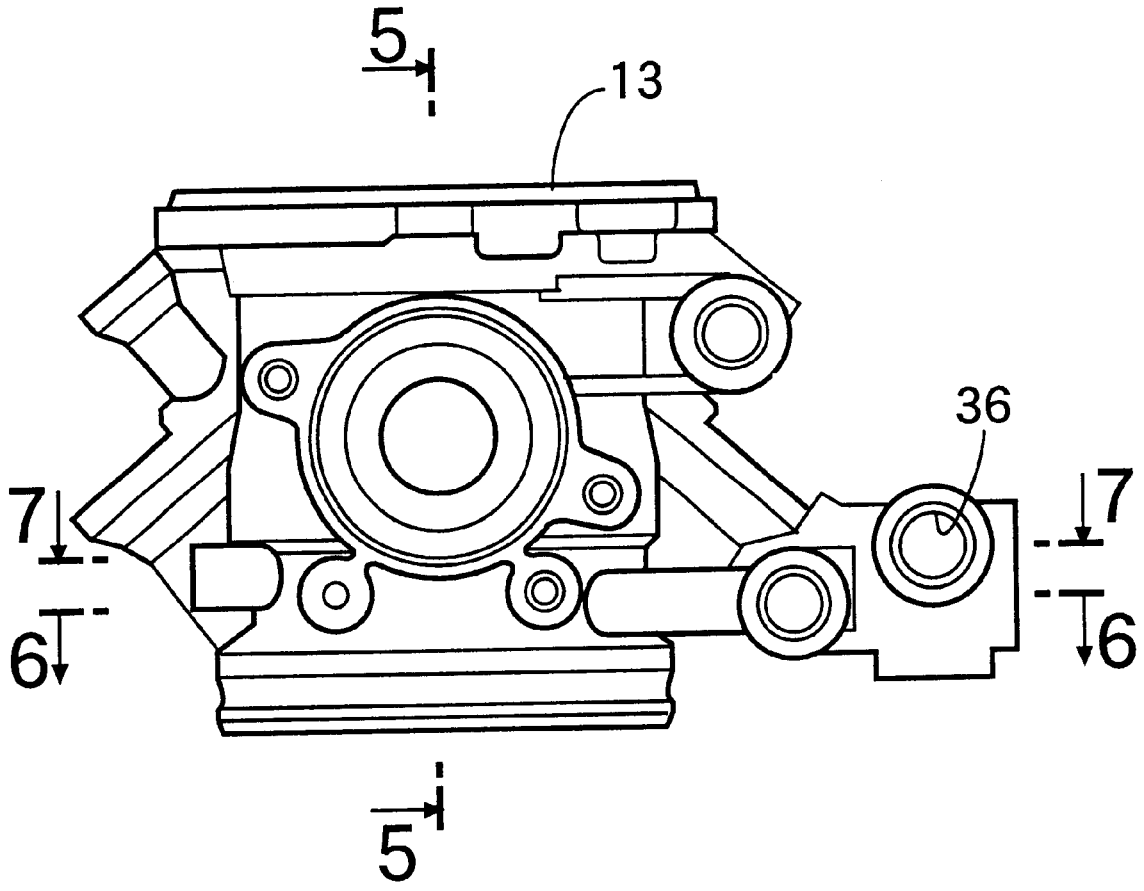
Figure 5:
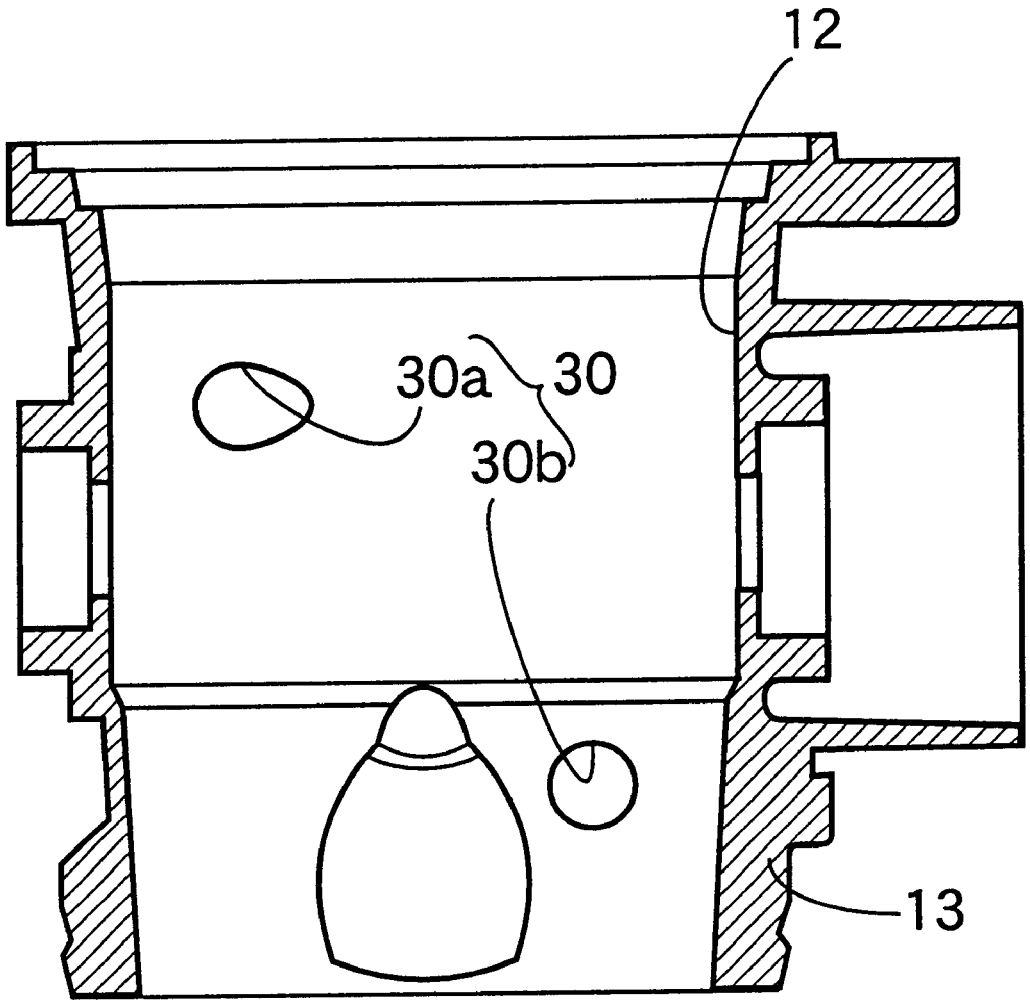
Figure 6:
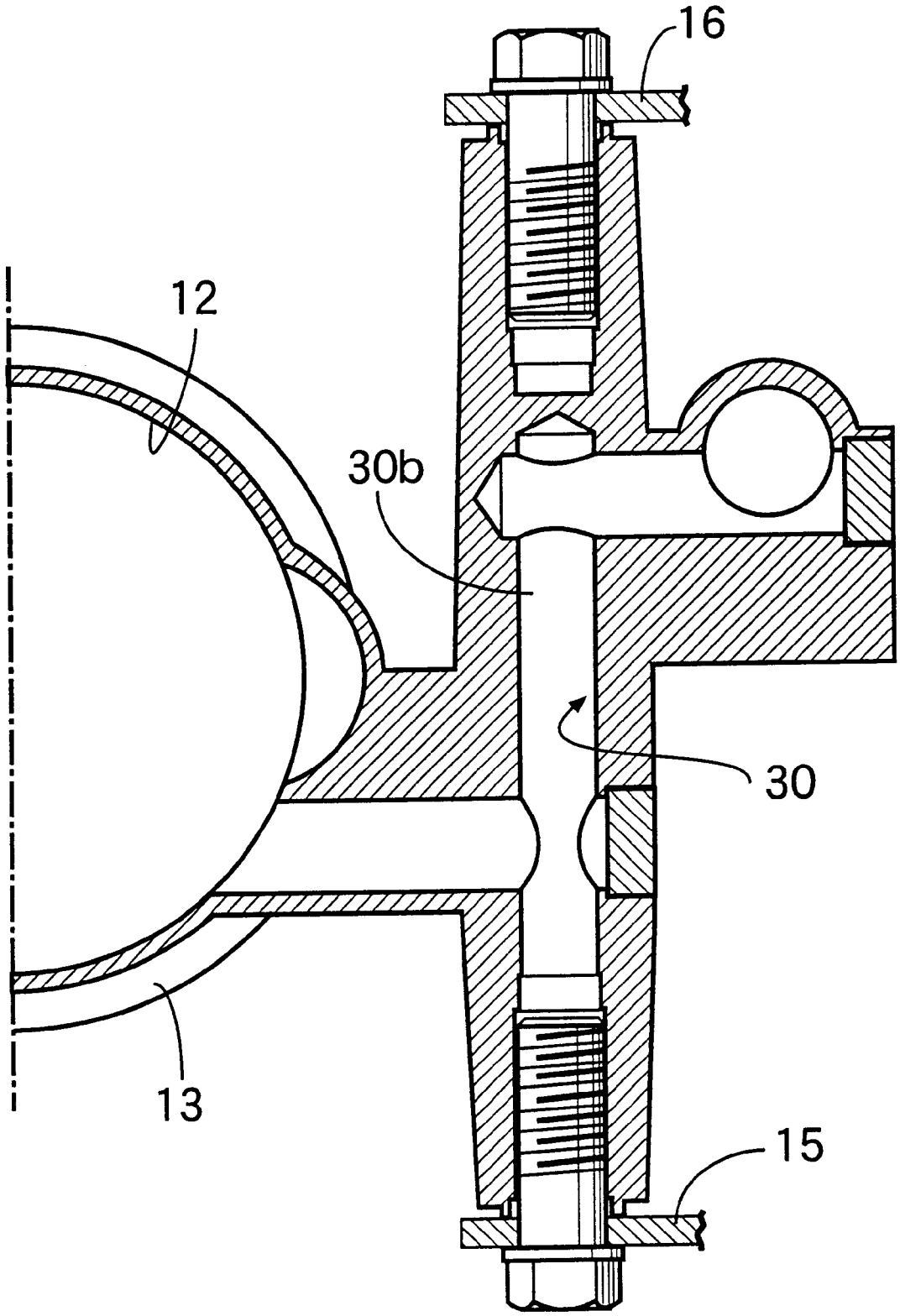
Figure 7:
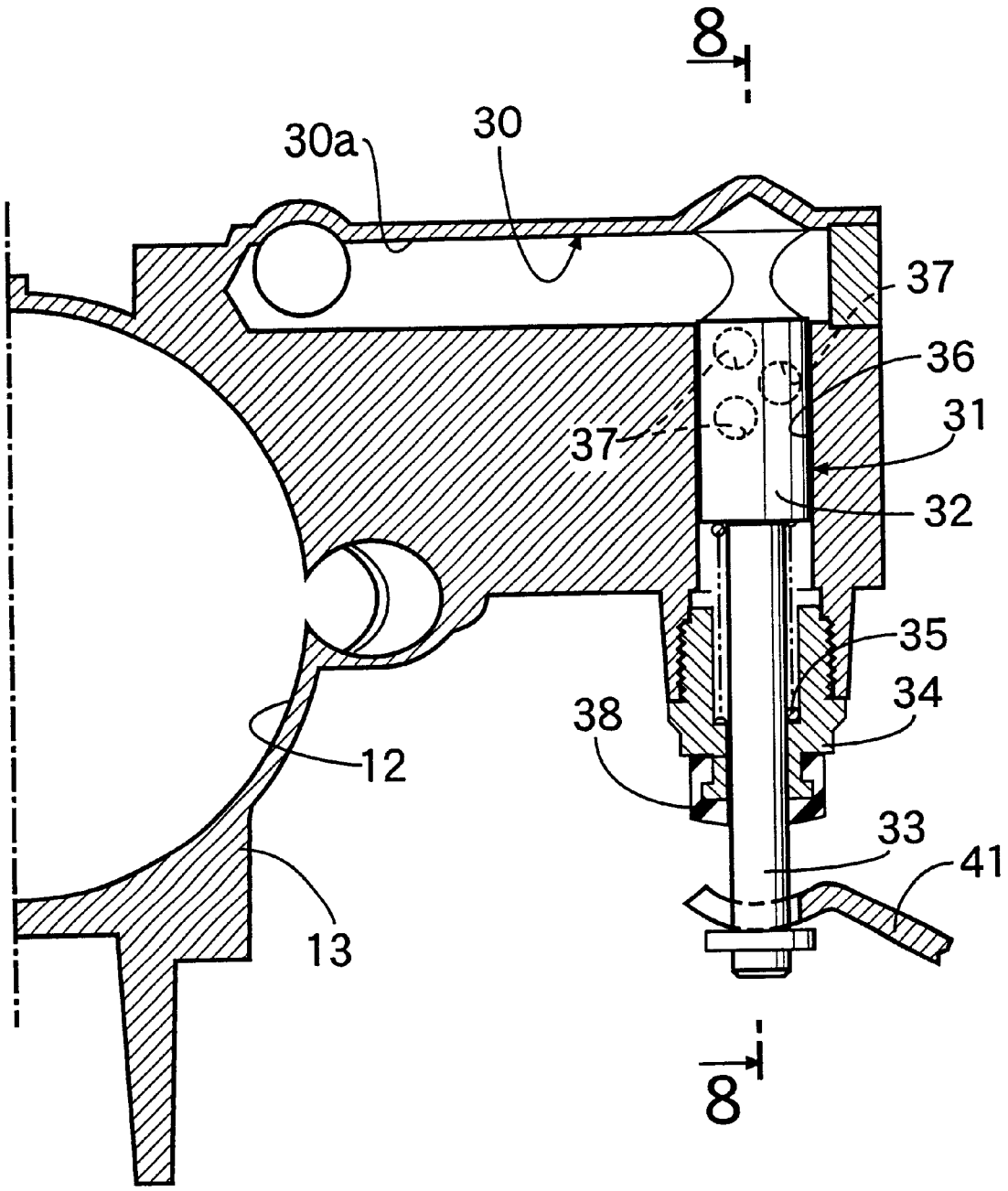

Referring especially to FIG. 3, the air control valves 31 are operated synchronously by the operation of a synchronizing mechanism 40 disposed between the throttle devices 11A and 11B forming the pair. The synchronizing mechanism 40 includes a first lever 41 supported on an inner surface of the connecting member 15 and connected to the air control valve 31 of the first throttle device 11A, a second lever 42 supported on an inner surface of the connecting member 16 and connected to the air control valve 31 of the second throttle device 11B, and a synchronizing member 43 which connects the first and second levers 41 and 42 to each other.

The first lever 41 is turnably supported by a support shaft 44 mounted in an inner surface of the connecting member 15, and is engaged and connected at one end thereof to an end of the rod 33 included in the air control valve 31 of the first throttle device 11A. A spring 45 is mounted between the first lever 41 and the connecting member 15 for biasing the first lever 41 in a direction to maintain the engagement and connection between the first lever 41 and the rod 33.

The second lever 42 is turnably supported by a support shaft 46 mounted in an inner surface of the connecting member 16, and is engaged and connected at one end thereof to an end of the rod 33 included in the air control valve 31 of the second throttle device 11B. A spring 47 is mounted between the second lever 41 and the connecting member 16 for biasing the second lever 42 in a direction to maintain the engagement and connection between the second lever 42 and the rod 33. Moreover, a regulating member 48 for regulating the position of engagement and connection of the second lever 42 to the rod 33 is threadedly engaged for advancing and retracting movements with the rod 33 included in the air control valve 31 of the second throttle device 11B.

The pair of intake passage bodies 13 are connected to each other by the pair of connecting members 15 and 16 so as to form a substantially right-angled tetragon by cooperation of the intake passage bodies 13, and the synchronizing member 43 connects the first and second levers 41 and 42 to each other to extend on a diagonal line of the right-angled tetragon.

A support stay 49 is secured to the inner surface of the connecting member 16, and an outer wire portion 51 of a choke wire assembly 50 comprising an inner wire 52 movably inserted through the outer wire 51 is supported at its end on the support stay 49. An engage piece 53 is secured to an end of the inner wire 52 protruding from the end of the outer wire 51, and is engaged and connected to the second lever 42. Therefore, the pulling of the choke wire assembly 50 causes the second lever 42 to be turned, whereby the air control valve 31 of the second throttle device 11B is driven, and the air control valve 31 of the first throttle device 11A is driven by the transmission of the turning movement of the second lever 42 to the first lever 41 through the synchronizing member 43, whereby the air control valve 31 of the first throttle device 11A is driven. Namely, the air control valves 31 of the first and second throttle devices 11A and 11B are operated synchronously by the pulling of the choke wire assembly 50.

A regulating screw 54 is threadedly engaged for advancing and retracting movements with the support stay 49, with a tip end thereof abutting against the second lever 42, for defining the minimum opening degree of the air control valves 31. A spring 55 is mounted between a rear end of the regulating screw 54 and the support stay 49 for preventing the loosing of the regulating screw 54.

The operation of the embodiment will be described below. The bypass passages 30 extending around the throttle valve 14 in the first and second throttle devices 11A and 11B disposed in the pair are provided in the intake passage bodies 13 in the throttle devices 11A and 11B, respectively, and the air control valves 31 for controlling the opening degrees of the bypass air passages 30 are mounted to the intake passage bodies 13 in the throttle devices 11A and 11B, respectively. Therefore, by controlling the amounts of air flowing through the bypass air passages 30 by the air control valves 31, the control of a small amount of air at the start of the engine can be carried out stably to stabilize the idling rotational speed, as compared with the prior art in which the amount of air at the start of the engine is controlled by decreasing the opening degrees of the throttle valves 14.

In addition, the bypass air passages 30 and the air control valves 31 are disposed on the opposed sides of the intake passage bodies 13 forming the pair. Therefore, an increase in size of the entire intake air amount control system can be avoided in spite of the provision of the bypass air passages 30 and the air control valves 31. Moreover, the synchronizing mechanism 40 for synchronously operating the air control valves 31 is also disposed between the throttle devices 11A and 11B forming the pair and hence, the size of the entire intake air amount control system cannot be increased due to the provision of the synchronizing mechanism 40.

In addition, the intake passage bodies 13 and the air control valves 31 having the identical shape are disposed symmetrically with each other with respect to the center C lying between the intake passages 12 and established on the straight line L passing through the axes of the intake passages 12. Therefore, the preparation of a plurality of types of throttle devices is not needed, thereby enabling a reduction in cost and a simplification of the construction of the synchronizing mechanism 40.

The pair of intake passage bodies 13 are connected to each other by the pair of connecting members 14 and 16 and hence, the sufficient strength of the throttle devices 11A and 11B can be ensured. Moreover, since each of the connecting members 15 and 16 is formed into the flat plate-shape, the shape of the connecting members 15 and 16 can be simplified to provide a reduction in cost. Additionally, since the synchronizing mechanism 40 is supported on the connecting members 15 and 16, an exclusive part for supporting the synchronizing mechanism 40 is not required, whereby the number of parts can be reduced.

The synchronizing mechanism 40 includes the first lever 41 supported on the inner surface of one of the connecting member 15 and connected to the air control valve 31 of the first throttle device 11A, the second lever 42 supported on the inner surface of the other connecting member 16 and connected to the air control valve 31 of the second throttle device 11B, and the synchronizing member 43 which connects the first and second levers 41 and 42 to each other. The synchronizing member 43 is disposed on the diagonal line of the substantially right-angled tetragon formed by the connecting members 15 and 16 and the intake passage bodies 13. With such arrangement of the synchronizing mechanism, it is possible to protect the synchronizing mechanism 40 by the connecting members 15 and 16 and moreover, to simplify the synchronizing mechanism 40.

Further, the choke wire assembly 50 is connected to the synchronizing mechanism 40 and supported on the connecting member 16 through the support stay 49. Therefore, the structure of interconnection of the synchronizing mechanism 40 and the choke wire assembly 50 can be simplified, while increasing the degree of freedom of disposition of the choke wire assembly 50.

Although the embodiments of the present invention have been described in detail, it will be understood that the present invention is not limited to the above-described embodiments, and various modifications in design may be made without departing from the spirit and scope of the invention defined in claims.

For example, the intake air amount control system including the throttle devices 11A and 11B disposed in the pair at each of the two points spaced from each other in the direction perpendicular to the rotational axes of the throttle valves 14 has been described in the embodiment, but the present invention is applicable to an intake air amount control system including a plurality of throttle devices disposed at each of the two points.

What is claimed is:

1. An intake air amount control system for an engine, comprising a plurality of throttle devices each of which comprises a butterfly-type throttle valve rotatably carried in an intake passage body defining an intake passage for controlling the opening degree of said intake passage, said throttle devices being disposed in a pair at each of two points spaced from each other in a direction perpendicular to rotational axes of said throttle valves, said intake passage bodies of said throttle devices disposed at said two points being connected to each other by at least one connecting member, said intake air amount control system comprising bypass air passages provided in opposed sides of said intake passage bodies forming a pair so as to extend around said throttle valves, respectively, air control valves mounted on the opposed sides of said intake passage bodies for controlling the opening degrees of said bypass air passages, respectively, and a synchronizing mechanism disposed between the pair of said throttle devices for synchronizing the operations of said air control valves.

2. An intake air amount control system according to claim 1, wherein said intake passage bodies forming the pair and having an identical shape and said air control valves mounted to said intake passage bodies and having an identical shape are disposed symmetrically with respect to a center between both said intake passages and established on a straight line passing through axes of said intake passages in said intake passage bodies.

3. An intake air amount control system according to claim 2, wherein said connecting member is formed into a flat plate-shape.

4. An intake air amount control system according to any of claims 1 to 3, wherein said synchronizing mechanism is supported on said connecting member.

5. An intake air amount control system according to claim 2 or 3, wherein said throttle passage bodies of said pair of throttle devices are disposed at a distance from each other in a direction parallel to the rotational axes of said throttle valves included in said throttle devices, and are connected to each other by a pair of said connecting members which form a substantially right-angled tetragon by cooperation with said intake passage bodies, and wherein said synchronizing mechanism includes a first lever supported on an inner surface of one of said connecting members and connected to said air control valve of one of said throttle devices, a second lever supported on an inner surface of the other connecting member and connected to said air control valve of the other throttle device, and a synchronizing member disposed on a diagonal line of said substantially right-angled tetragon and connecting said first and second levers to each other.

6. An intake air amount control system according to claim 1, wherein a choke wire assembly is supported on said connecting member and connected to said synchronizing mechanism.

* * * * *